US007220904B2

(12) United States Patent
Rom

(10) Patent No.: US 7,220,904 B2
(45) Date of Patent: May 22, 2007

(54) BELL AND CLAPPER FOR BELLS

(76) Inventor: Walter Rom, Georg-Rom-Weg 1, Kundl/Tirol (AT) A-6250

( * ) Notice: Subject to any disclaimer, the term of this patent is extended or adjusted under 35 U.S.C. 154(b) by 213 days.

(21) Appl. No.: 10/980,955

(22) Filed: Nov. 4, 2004

(65) Prior Publication Data

US 2005/0211059 A1 Sep. 29, 2005

(30) Foreign Application Priority Data

Mar. 24, 2004 (AT) ..... 514/2004

(51) Int. Cl.
*G10K 1/32* (2006.01)

(52) U.S. Cl. ..... 84/406; 84/402; 84/403; 84/404; 84/406; 84/408; 84/409; 84/410

(58) Field of Classification Search ..... 84/402–404, 84/406, 408–410; 116/171
See application file for complete search history.

(56) References Cited

U.S. PATENT DOCUMENTS 102,016 A * 4/1870 Kintz, Jr. ..... 116/171
116,241 A * 6/1871 Volger ..... 116/171
236,652 A * 1/1881 Torrey ..... 116/171
294,184 A * 2/1884 Barton ..... 116/171
623,589 A * 4/1899 Woms ..... 116/2
774,234 A * 11/1904 Deagan ..... 116/171
870,025 A * 11/1907 Elsas ..... 84/406
2,521,336 A * 9/1950 Bramson ..... 84/422.4
2,695,589 A * 11/1954 Hubbell ..... 116/150
2,787,929 A * 4/1957 Musser ..... 84/406
2,800,870 A * 7/1957 Garthwait ..... 116/155
2,880,693 A * 4/1959 Ferdinando ..... 116/155
3,139,855 A * 7/1964 Kunz ..... 116/171
3,146,659 A * 9/1964 Robba et al. ..... 84/422.4
3,165,964 A * 1/1965 Stys et al. ..... 84/422.4
3,253,574 A * 5/1966 Malta ..... 116/171
3,301,119 A * 1/1967 Gilbert ..... 84/422.4
3,693,287 A * 9/1972 Martin ..... 446/303
3,941,082 A * 3/1976 Malta ..... 116/171
4,062,317 A * 12/1977 Malta ..... 116/171
4,186,682 A * 2/1980 Longsdorf et al. ..... 116/171
4,484,535 A * 11/1984 Hayward ..... 116/171
4,566,400 A * 1/1986 Keenan et al. ..... 116/171
D289,620 S * 5/1987 Murtagh ..... D10/116
5,179,237 A * 1/1993 Grossman ..... 84/422.4
5,235,893 A * 8/1993 Malta ..... 84/406
5,975,008 A * 11/1999 Malta ..... 116/171
6,302,813 B1 * 10/2001 Sturgeon et al. ..... 473/564
6,346,664 B1 * 2/2002 Shuen ..... 84/402

(Continued)

FOREIGN PATENT DOCUMENTS

AT 006 144 U2 5/2003

(Continued)

*Primary Examiner*—Lincoln Donovan
*Assistant Examiner*—Robert W Horn
(74) *Attorney, Agent, or Firm*—Laurence A. Greenberg; Werner H. Stemer; Ralph E. Locher

(57) ABSTRACT

A clapper for a bell is hollow on the inside for receiving objects, such as a personal dedication. The clapper may also be provided with a coating for damping the volume of the bell strike, or at least change the sound.

12 Claims, 3 Drawing Sheets

U.S. PATENT DOCUMENTS

| | | | | |
|---|---|---|---|---|
| 6,722,308 | B1 * | 4/2004 | Moulden | 116/171 |
| 6,739,282 | B1 * | 5/2004 | Yuan | 116/167 |
| 6,871,613 | B2 * | 3/2005 | Murray et al. | 116/148 |
| 2005/0211059 | A1 * | 9/2005 | Rom | 84/406 |

FOREIGN PATENT DOCUMENTS

| | | |
|---|---|---|
| DE | 102 21 809 C1 | 4/1973 |

* cited by examiner

BELL AND CLAPPER FOR BELLS

BACKGROUND OF THE INVENTION

Field of the Invention

The invention relates to bells and clappers for bells. In this context, the term "bell" should be understood to include the entire range of bells, from simple table-top bells through personal dedication bells and to church bells.

Clappers for bells are preferably cast by the investment casting process. They are solid and for the most part made from the same metal as the bell to which the respective clapper belongs. However, it is also known to produce clappers by the sand casting process or to forge them. Common to all these processes is that the clappers are formed in one piece.

Bells, and particularly church bells or tower bells, are for the most part wherein by a harsh, metallic sound and in particular by a hard impact. Nowadays, many local residents do not appreciate the striking of bells but instead feel that they disturb the peace, in particular in the early hours of the morning, especially on weekends.

Bells are sometimes used to leave messages for posterity. I have previously described a method of producing bells with general inscriptions or personal dedication messages in German patent DE 102 21 809 C1 and in my Austrian utility model (Gebrauchsmuster) AT 006 144 U2. The earlier disclosures are herewith incorporated by reference in their entirety.

In some respects, the inscription of such bells is quite cumbersome and, upon casting, the inscription message cannot easily be changed.

SUMMARY OF THE INVENTION

It is accordingly an object of the invention to provide a bell and a clapper for a bell which overcomes the above-mentioned disadvantages of the heretofore-known devices and methods of this general type and which provides for an assembly that is enabled to receive a message other than or in addition to the permanently marked inscription or inlay and which is provided with means for changing the impact noise caused by the clapper hitting the bell.

The objects are primarily achieved by modifying the bell clapper and by providing a clapper that is suitable for receiving and storing a message and/or that is provided with a coating that lessen the effect of the striking of the clapper with respect to its volume and/or its harmonics distribution.

With the foregoing and other objects in view there is provided, in accordance with the invention, a clapper for a bell, comprising:

a shaft having a suspension device for suspending the shaft from the bell;

a striking part at a bottom of the shaft opposite the suspension device;

at least one of the shaft and the striking part having a void formed therein for receiving and storing therein a dedication item.

In accordance with an added feature of the invention, the shaft is a hollow shaft and the striking part is a solid part attached to the shaft. In one embodiment, the shaft and the suspension device are integrally formed in one piece. In another embodiment, the shaft and the striking part are integrally formed in one piece. In a preferred embodiment, the striking part is a clapper ball formed with a thread, and the shaft is formed with a thread meshing with the thread of the clapper ball.

In accordance with an additional feature of the invention, the void is a hollow space extending through the shaft and into the striking part, or it is a bore longitudinally formed in the shaft and the striking part is a substantially solid clapper ball.

In accordance with another feature of the invention, an impact-damping coating is formed on the striking part. This changes the sound of the bell by triggering a different harmonics distribution than when the metal body of the clapper impinges on the metal of the bell.

In accordance with a preferred embodiment of the invention, the coating is a soft material such as PTFE (polytetrafluoro-ethylene, Teflon®), natural rubber, synthetic rubber, or plastic. The coating may be provided only on the striking part or it may cover a major portion of the clapper.

With the above and other objects in view there is also provided, in accordance with the invention, a clapper for a bell, comprising:

a shaft having a suspension device for suspending the shaft from the bell;

a striking part at a bottom of the shaft opposite the suspension device; and an impact-damping coating formed on the striking part.

In a preferred embodiment, there is provided a personal dedication bell that has a bell body formed with an inscription or an embellishment and a clapper as outlined above. The clapper may be the hollow clapper and it may be the clapper with the coating. The combination of the two clapper features, of course, is a preferred embodiment.

If it is desired, in particular in the context of a personal dedication bell, to leave a message for posterity that cannot be left on the bell itself in the form of symbols or an inscription or is deliberately not to be left on the bell, the clapper itself may bear this message. It goes without saying that clappers of church tower bells are also suitable for this.

By contrast with conventional clappers, the clapper according to the invention is made in a hollow form. The desired message is introduced into this hollow space.

The shaft of the clapper is preferably made in a hollow form. In this case, it can be connected in one piece to the suspension device or the striking part. However, as far as handling is concerned, it is likely to be easier to make the clapper in two or three parts, that is comprising the suspension device, the striking part and the hollow shaft. In the case of a two-part configuration, the shaft may either be in one piece with the suspension device or with the striking part.

After introducing the message, the shaft is connected to the suspension device and/or the striking part.

All the known elements and processes come into consideration as connecting elements and connecting processes. Preferred processes are soldering and adhesive bonding; screwing is most particularly preferred.

If the bell is a personal dedication bell, sometimes also referred to as a lifetime bell, several variants are possible. The message may be located only in or on the clapper, it may be located only on the bell and it may be located both in or on the clapper and on the bell. If the message is only located on the bell, the clapper can readily be produced by the process according to the invention.

A personal dedication bell or lifetime bell is devoted to a person throughout his entire life. For example, in a Christian context, the bell is given to the child by his godparents when he is born or christened. Since it is a very personal gift from a person with whom there is normally a very strong relationship, it usually bears a dedication, which is usually provided on the outside of the bell.

Since bells are usually custom made, with many differently dimensioned variants, it is not economical to produce a mold for casting a wax model. The situation is different with lifetime bells. They only require a small number of different sizes, which are frequently repeated, since these bells derive their originality from the inscriptions provided by the persons giving them. Here there is a reason to produce molds for casting wax models of the bells.

Molds for casting the wax models of lifetime or personal dedication bells may consist of the customary materials for corresponding permanent molds. Once the wax model has been made, it is passed on to the person giving the bell so that he can engrave an inscription. He either does this himself or has it engraved. It is preferred for him to make the engraving himself, in his own handwriting, since this is the best way of showing the uniqueness and originality of this particular lifetime bell.

In the case of large bells, and consequently large, voluminous clappers, there is the possibility of introducing a slot into the side of the shaft of the one-piece clapper, for example by milling, to introduce the message into the slot and then close the slot with a panel, the panel preferably being connected to the clapper by screws. In this case, the slot may be provided on one side or right through. In the latter case, it can of course also be closed on both sides.

To moderate the harsh sound of the clapper striking, I provide here at least the striking part of the clapper with a coating lessening the impact. Not only is the impact lessened—in fact, the momentum transfer remains the same, whether the clapper is coated or bare metal—but the bell develops a different sound. This may be due to the fact that a softer clapper develops more of the base harmonics and less of the upper harmonics, or simply provides for a more rounded distribution of the various harmonics amplitudes. The coating may, for example, consist of PTFE (Teflon®) or of a natural rubber or a synthetic rubber. Suitable plastics may also be used. It has been found that all materials with which good sound damping is achieved and which at the same time are highly wear resistant can be used.

Previous tests have shown that bells with clappers coated with rubber have a much less harsh sound.

Other features which are considered as characteristic for the invention are set forth in the appended claims.

Although the invention is illustrated and described herein as embodied in a bell and clapper for bells, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
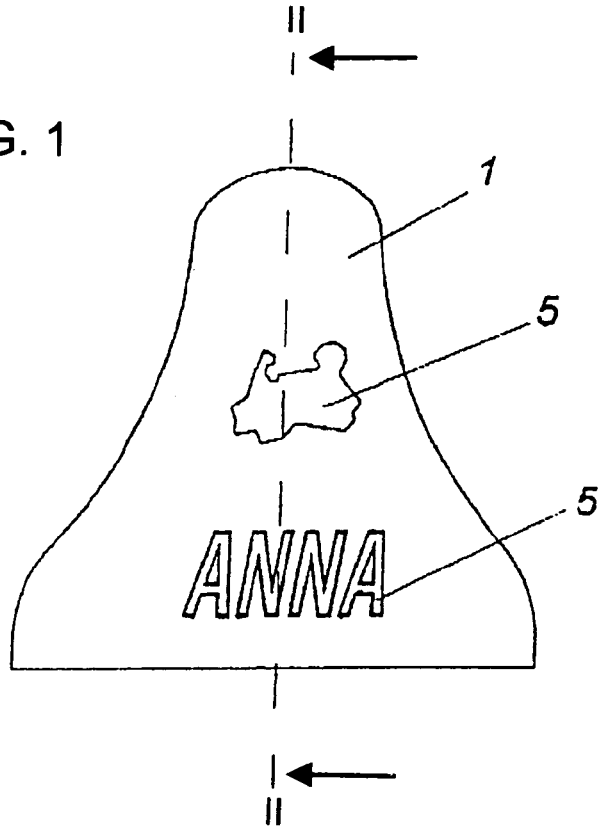
FIG. 1 is a side view of a bell with two personal inscription fields.

Referring now to the figures of the drawing in detail and first, particularly, to FIG. 1 thereof, there is shown a finished bell 1 with a recessed inscription and/or embellishment 5, the inscription and/or embellishment 5 being designed individually by the customer or a person specified by him.

The bell 1 is produced with the following process:

Firstly, a wax model 2 of the bell 1 is produced in a basic form. This wax model 2 will have no or only minor, simple embellishments, since the primarily important part of the present invention is that the customer or a person specified by him can individually design the bell 1 on the basis of the wax model 2.

Figure 3:
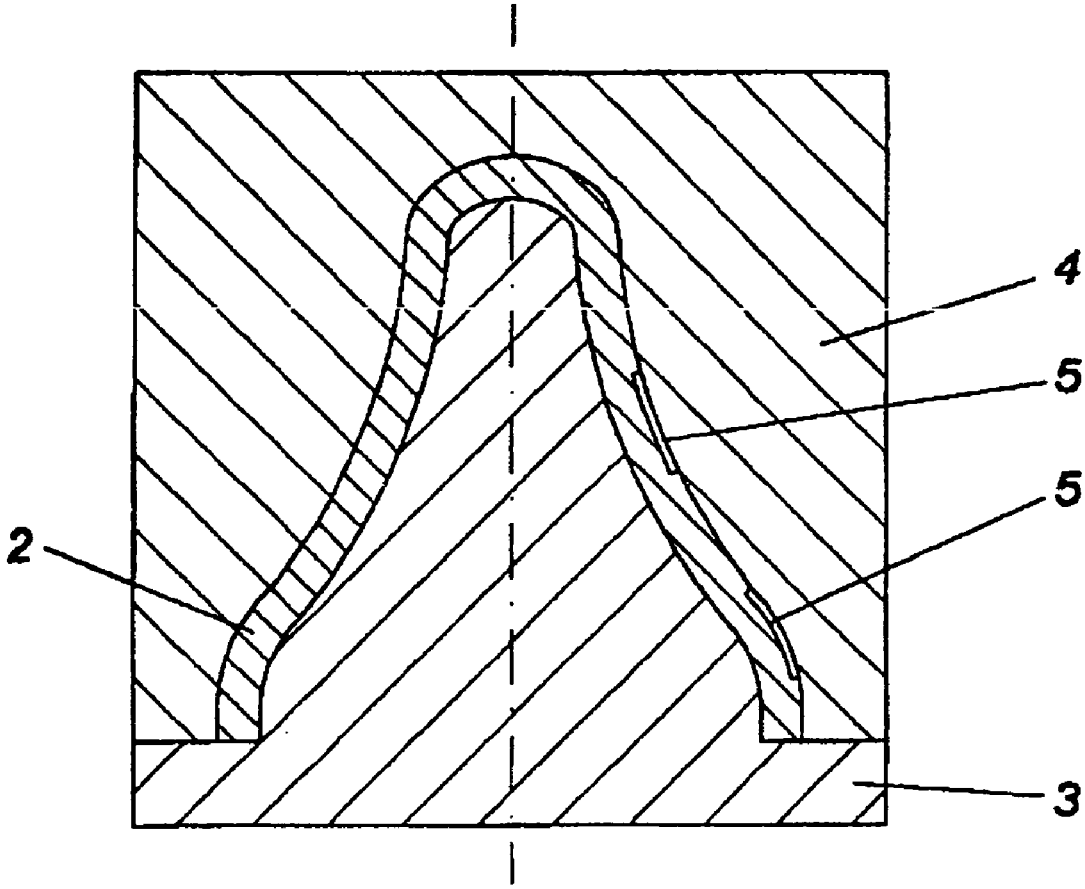
FIG. 3 is a sectional view taken along the same plane through a positive wax model of the bell and its surrounding transport packaging, and viewed from the opposite direction as compared to FIG. 2.

Since the wax model 2 is very sensitive, it must subsequently be provided with a transport packaging, which protects it on all sides. In the case of the exemplary embodiment represented in FIG. 3, the transport packaging is designed to be of two parts and has an inner core 3 and a casing 4. The core 3 and the casing 4 may for example consist of polyurethane foam, which combines high stability with low weight. However, a box or crate lined with shock-absorbing material (wool, foam, etc.) may also be used as transport packaging.

The customer for the bell 1 or a person specified by him can then provide an individual inscription and/or embellishment 5 on the wax model 2 away from the foundry. This involves removing wax from the wax model 2, so that recessed inscriptions and/or embellishments 5 are produced on the finished bell 1. Since wax can be worked well, any sharp implement, in particular including a pencil, can be used for engraving the inscriptions and/or embellishments 5.

The customized wax model is subsequently taken to the foundry, preferably using the original transport packaging, where it is enclosed in a mold and melted away, after which the bell 1 is cast.

A clapper 6 is centrally suspended inside the bell. The bell 2 is provided with a ring loop 7 at the center dome and the clapper 6 is suspended with a further ring loop 8. The clapper 6 of the illustrated embodiment is formed of two parts, namely, a hollow shaft 9 and a cap ball 10. The shaft 9 is formed with a substantially cylindrical longitudinal bore 11 wherein a dedication, a scroll or the like, may be stored. The open end of the bore 11 is threaded. The thread is configured to mesh with a counter-thread on the clapper ball 10.

It will be understood, of course, that the shaft 9 and the striking part—i.e., the ball 10 in the illustrated embodiment—may be formed in one piece. In that case, the shaft 9 would flare out towards the bottom and then round back. The very bottom may then be capped off with a small access opening, allowing access into the bore 11.

Figure 4:
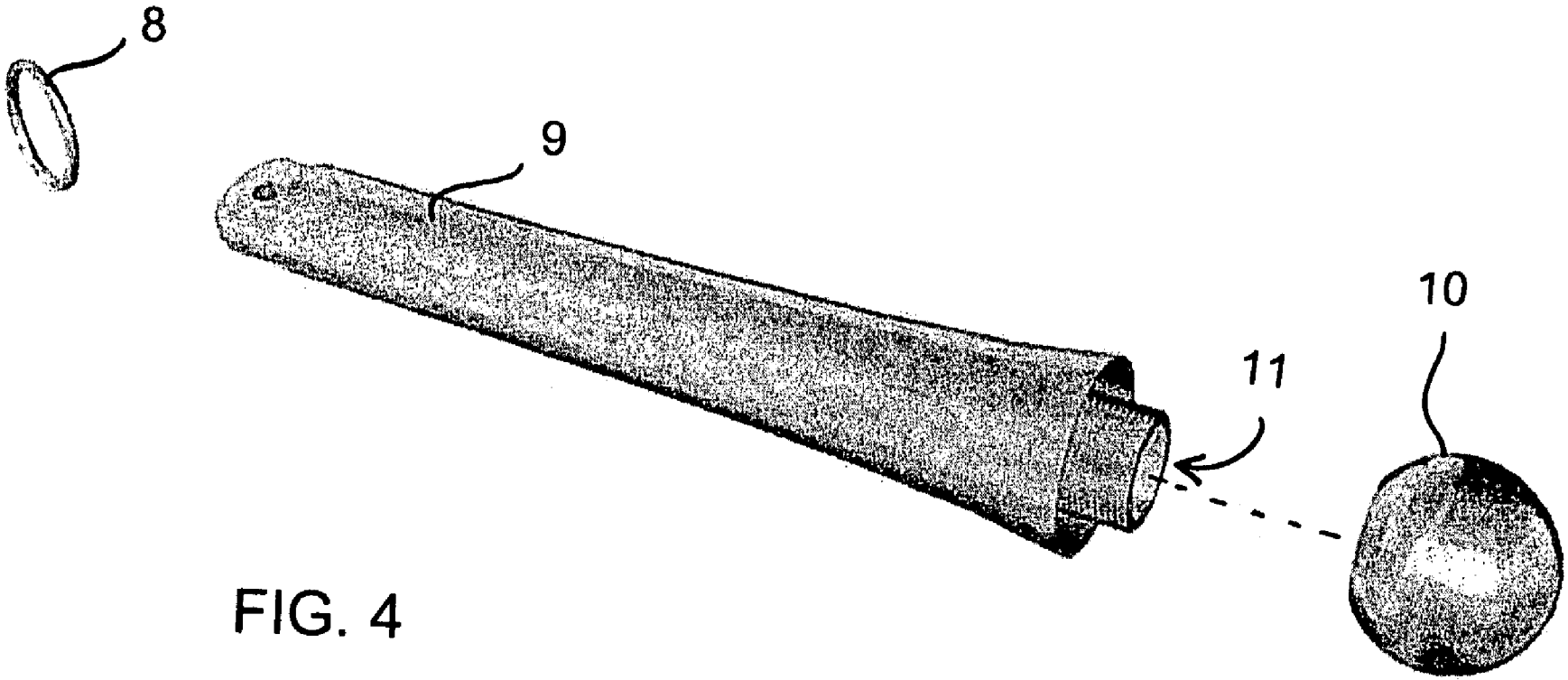
FIG. 4 is an exploded perspective view of the clapper according to the invention, and enlarged relative to the illustration in FIG. 2.

FIG. 4 illustrates the clapper 6 in exploded view and in a slightly modified embodiment. Here, the ball 10 is provided with a threaded bore and the shaft 9 is provided with the male thread. The illustration further shows the flare of the outer surface of the shaft towards the bottom, which ensures that the outer surface of the shaft 9 smoothly merges with the peripheral surface of the ball 10.

While the suspension ring loop 8 is illustrated as a separate component, it is understood that it may be integrally formed with the clapper or with the bell. 4. It may also be soldered or welded, or glued to the shaft or to the bell, or it may be bolted or screwed. It is also understood that the clapper may be integrally formed in one piece, i.e., with the shaft and the ball 10, i.e., the striking part, formed as one. The hollow space, then, may be provided with a side access opening, that may be closed, for example, with a cover plate or the like.

While the illustration shows a relatively small bore 11, the same may be formed to take up virtually the entire space inside the clapper 6. In that case, the bore 11 would extend the entire length of the shaft 9 and be formed in the ball 10.

Figure 2:
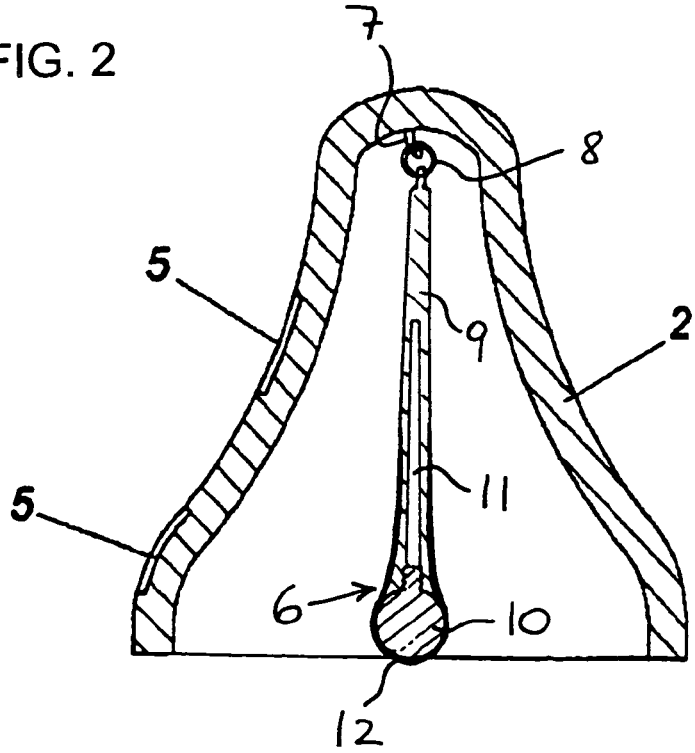
FIG. 2 is a section through the bell of FIG. 1 taken along the line II—II and viewed in the direction of the arrows.

In a preferred embodiment, as illustrated in FIG. 2, the clapper 6 is coated with an impact-damping coating 12. The coating 12 may be a Teflon® coat, or it may be natural rubber, synthetic rubber, or any suitable plastic composition.

The coating 12 should be wear resistant. It is quite advantageous, however, that the coating may be easily renewed in the event of wear. For instance, it may be sprayed or the clapper 6 may be immersed into a liquid bath of a solution that, upon curing, forms the coating 12. The coating may be limited to just the striking part of the clapper, or it may cover nearly the entire clapper 6. In one embodiment, as illustrated in FIG. 2, the coating is applied after the ball 10 has been screwed to the shaft 9—with the dedication scroll inside the bore 11—so as to completely seal the bore 11 from moisture and the like. A Teflon® or rubber coating 12 can then be relatively easily broken if access is to be had to the dedication scroll.

I claim:

1. A clapper for a bell, comprising:

a shaft having a suspension device for suspending said shaft from the bell;

a striking part at a bottom of said shaft opposite said suspension device;

at least one of said shaft and said striking part having an enclosed void formed therein for receiving and storing therein a dedication item.

2. The clapper according to claim 1, wherein said shaft is a hollow shaft and said striking part is a solid part attached to said shaft.

3. The clapper according to claim 1, wherein said shaft and said suspension device are integrally formed in one piece.

4. The clapper according to claim 1, wherein said shaft and said striking part are integrally formed in one piece.

5. The clapper according to claim 1, wherein said striking part is a clapper ball formed with a thread, and said shaft is formed with a thread meshing with said thread of said clapper ball.

6. The clapper according to claim 1, wherein said void is a hollow space extending through said shaft and into said striking part.

7. The clapper according to claim 1, wherein said void is a bore longitudinally formed in said shaft and said striking part is a substantially solid clapper ball.

8. The clapper according to claim 1, which comprises an impact-damping coating formed on said striking part.

9. The clapper according to claim 8, wherein said coating is a coating of a material selected from the group consisting of PTFE, natural rubber, synthetic rubber, and plastic.

10. The clapper according to claim 8, wherein said coating is formed of a softer material than said striking part.

11. The clapper according to claim 8, wherein said coating covers said striking part and at least a part of said shaft.

12. A personal dedication bell assembly, comprising:

a bell body formed with an inscription or an embellishment, said bell body having an inside with an inside dome;

a hollow clapper suspended from said inside dome, said clapper having a shaft and a striking part at a bottom of said shaft, said hollow clapper having an enclosed void formed in at least one of said shaft and said striking part for receiving and storing therein a personal dedication item.

* * * * *